US005717825A

United States Patent [19]

Lamblin

[11] Patent Number: 5,717,825

[45] Date of Patent: Feb. 10, 1998

[54] ALGEBRAIC CODE-EXCITED LINEAR PREDICTION SPEECH CODING METHOD

[75] Inventor: Claude Lamblin, Perros Guirec, France

[73] Assignee: France Telecom, Paris, France

[21] Appl. No.: 682,721

[22] PCT Filed: Jan. 4, 1996

[86] PCT No.: PCT/FR96/00017

§ 371 Date: Aug. 26, 1996

§ 102(e) Date: Aug. 26, 1996

[87] PCT Pub. No.: WO96/21221

PCT Pub. Date: Jul. 11, 1996

[30] Foreign Application Priority Data

Jan. 6, 1995 [FR] France ..... 95 00133

[51] Int. Cl.[6] ..... G10L 7/00

[52] U.S. Cl. ..... 395/2.32; 395/2.28; 395/2.09; 395/2.1; 395/2.29

[58] Field of Search ..... 395/2.09, 2.1, 395/2.28, 2.29, 2.3, 2.32

[56] References Cited

U.S. PATENT DOCUMENTS

| | | | |
|---|---|---|---|
| 4,868,867 | 9/1989 | Davidson et al. | 395/2.32 |
| 4,899,385 | 2/1990 | Ketchum et al. | 395/2.32 |
| 4,910,781 | 3/1990 | Ketchum et al. | 395/2.32 |
| 4,945,565 | 7/1990 | Ozawa et al. | 395/2.32 |
| 4,945,567 | 7/1990 | Ozawa et al. | 395/2.32 |
| 5,195,137 | 3/1993 | Swaminathan | 395/2.32 |
| 5,230,036 | 7/1993 | Akamine et al. | 395/2.08 |
| 5,265,167 | 11/1993 | Akamine et al. | 395/2.08 |
| 5,444,816 | 8/1995 | Adoul et al. | 395/2.28 |
| 5,495,555 | 2/1996 | Swaminathan | 395/2.16 |
| 5,583,963 | 12/1996 | Lozach | 395/2.28 |

FOREIGN PATENT DOCUMENTS

| | | |
|---|---|---|
| WO 91/13432 | 9/1991 | Canada . |
| 0424121 | 4/1991 | Japan . |

OTHER PUBLICATIONS

Laflamme et al, "16 KBPS Wideband Speech Coding Technique Based on Algebraic Celp", ICASSP 1991: acoustics, Speech and Signal Processing, pp. 13–16, Jul. 1991.

Lamblin et al, "Fast Celp Coding Based on the Barnes–Wall Lattice in 16 Dimensions", ICASSP 1989: Acoustics, Speech and Signal Processing, pp. 61–64, Feb. 1989.

Menez et al, "A 2 ms–Delay adaptive Code Excited Predictive Coder", ICASSP 1990, Acoustics, Speech and Signal Processing Conference, pp. 457–460, Feb. 1990.

Laflamme et al, "On Reducing Computational Complexity of Codebook Search in CELP Coder Through the Use of Algebraic Codes", ICASSP 1990: Acoustics, Speech and Signal Procecssing, pp. 177–180, Feb. 1990.

U.S. Ser. No. 296,764, Ketchum et al., filed Dec. 1988.

U.S. Ser. No. 497,479, Swaminathan, filed Aug. 1992.

U.S. Ser. No. 379,296, Chen, filed Apr. 1991.

Steger, "On the Use of a Constant Autocorrelation Codebook for CELP Coding", Signal Processing VI, Proceeding of EUSIPCO 92, vol. 1, Aug. 1992, pp. 467–470, Aug. 1992.

Delprat et al, "A 6 KBPS Regular Pulse Celp Coder for Mobile Radio Communications", Advances in Speech Coding, Jan. 1991, pp. 179–188, Jan. 1991.

Gersho, "Advances in Speech and Audio Compression", Proceedings of the IEEE, vol. 82, Jun. 1994, pp. 900–918, Jun. 1994.

*Primary Examiner*—Allen R. MacDonald
*Assistant Examiner*—Michael Opsasnick
*Attorney, Agent, or Firm*—Oliff & Berridge

[57] ABSTRACT

The method uses the technique of CELP coding with algebraic codebook. The search for the CELP excitation includes a calculation of certain components of the covariance matrix $U=H^T \cdot H$ where H denotes a lower triangular Toeplitz matrix formed on the basis of the impulse response of a compound filter made up of synthesis filters and of a perceptual weighting filter. The memory-stored components of the covariance matrix are only those of the form $U(pos_{i,p}, pos_{i,p})$ and those of the form $U(pos_{i,p}, pos_{j,q})$, $pos_{i,p}$ and $pos_{j,q}$ respectively denoting position i and position j for the pulses p and q in the codes of the algebraic codebook.

13 Claims, 9 Drawing Sheets

$i_{N-1} = 0$
$122_{N-1}$
$124_{N-1}$
$P(N-1) = P(N-2) + S_{N-1}.D[\delta(i_{N-1}N+N-1)+\varepsilon]$
$\alpha^2(N-1) = \alpha^2(N-2) + S_{N-1}.R_{N-1,N-1}(i_{N-1}) + 2.S_{N-1}\sum_{p=0}^{N-2} S_p.R_{p,N-1}(i_p,i_{N-1})$
YES
$P^2(N-1)<T(N-1).\alpha^2(N-1)$?
NO
$126_{N-1}$
$T(N-1) = P^2(N-1)/\alpha^2(N-1)$
$\beta = P(N-1)/\alpha^2(N-1)$
$k = i_0 + i_1.L' + ... + i_{N-1}(L')^{N-1}$
128
$i_{N-1} = i_{N-1}+1$
$130_{N-1}$
$B_{N-1}$
YES
$i_{N-1} = L'$ ?
NO
$132_{N-1}$
$i_q = i_q + 1$
$130_q$
$B_q$
YES
$i_q = L'$ ?
NO
$132_q$
$i_1 = i_1 + 1$
$130_1$
$B_1$
YES
$i_1 = L'$ ?
NO
$132_1$
$i_0 = i_0 + 1$
$130_0$
$B_0$
YES
$i_0 = L'$ ?
NO
$132_0$
END

ALGEBRAIC CODE-EXCITED LINEAR PREDICTION SPEECH CODING METHOD

The present invention relates to a method of digital coding, in particular of speech signals.

BACKGROUND OF THE INVENTION

One of the best current methods of compressing signals in order to reduce the bit rate while still maintaining good quality is the technique of code-excited linear prediction CELP. This type of coding is widely used, essentially in terrestrial or satellite transmission systems, or in storage applications. However, the first generation of CELP coders which used stochastic codebooks was very complex to implement and required large memory capacities. A second generation of CELP coders then appeared: algebraic codebook CELP coders. They are less complex to implement and require less memory, but the savings are still inadequate.

The technology of algebraic codebook CELP coding has been further improved by the introduction of ACELP (Algebraic Code Excited Linear Prediction) coders which use an algebraic codebook associated with a focused search with adaptive thresholds allowing the complexity of the calculation to be adjusted. However, the amount of random-access memory required is still substantial.

The CELP coders belong to the family of analysis-by-synthesis coders, in which the synthesis model is used at the coder. The signals to be coded may be sampled at the telephone frequency (Fe=8 kHz) or a higher frequency, for example 16 kHz for wideband coding (passband from 0 to 7 kHz). Depending on the application and the quality desired, the compression factor varies from 1 to 16: CELP coders operate at bit rates of from 2 to 16 kbits/s in the telephone band, and at bit rates of from 16 to 32 kbits/s in wideband.

In a digital coder of CELP type, the speech signal is sampled and converted into a string of frames of L samples. Each frame is synthesized by filtering a waveform extracted from a codebook (also referred to as a dictionary), and multiplied by a gain through two time-varying filters. The excitation codebook is a set of K codes or waveforms of L samples. The waveforms are numbered by an integer index k, k ranging from 0 to K−1, K being the size of the codebook. The first filter is the long-term prediction filter. An "LTP" (Long Term Prediction) analysis allows evaluation of the parameters of this long-term predictor and thus exploitation of the periodicity of the voiced sounds (for example: the vowels); this long-term correlation is due to the vibration of the vocal chords. The second filter is the short-term prediction filter. The methods of analysis by linear prediction "LPC" (Linear Prediction Coding) make it possible to obtain these short-term prediction parameters representative of the transfer function of the vocal tract and characteristic of the spectrum of the signal. The method used to determine the innovation sequence is the method of analysis by synthesis: at the coder, all the innovation sequences of the excitation codebook are filtered by the two filters, LTP and LPC, and the waveform selected is that producing the synthetic signal closest to the original speech signal, according to a perceptual weighting criterion.

In a CELP coder, the excitation of the synthesis model therefore consists of waveforms extracted from a codebook. Depending on the type of this codebook, two kinds of CELP coders are distinguished. The codebooks of the first CELP coders consisted of stochastic waveforms. These codebooks are obtained either by learning or by random generation.

Their major drawback is their lack of structure which makes it necessary to store them and gives rise to a high complexity of implementation. The excitation codebook of the first CELP coder was a stochastic dictionary, made up of a set of 1024 waveforms of 40 Gaussian samples. This CELP coder did not operate in real time on the most powerful computers of that era. Other stochastic dictionaries allowing a reduction in the necessary memory and computation time have been introduced; however, both the complexity and the memory capacity required remained substantial.

To remedy this drawback, another category of codebooks has been proposed: highly structured algebraic codebooks which need not be stored and whose structure allows the development of fast algorithms for their implementation. A. Gersho, in his article "Advances in Speech and Audio Compression" (Proc. IEEE, Vol. 82, No. 6, June 1994, pages 900–918), has presented a good overview of the work in CELP coding and drawn up an inventory of the various codebooks proposed in the literature. One of the CELP coders which uses an algebraic codebook is the ACELP coder.

ACELP coders (see WO 91/13432) have been proposed as candidates for several standardizations: 8 kbits/s ITU (International Telecommunications Union) standardization, ITU standardization for the 6.8 kbits/s-5.4 kbits/s PSTN viewphone. The short-term prediction, LTP analysis and perceptual weighting modules are similar to those used in a conventional CELP coder. The original feature of the ACELP coder lies in the excitation signal search module. The ACELP coder has two major benefits: high flexibility in terms of bit rate and adjustable complexity of implementation. The bit-rate flexibility stems from the method for generating the codebook. The possibility of adjusting the complexity is due to the waveform selection procedure which uses a focused search with adaptive thresholds.

In an ACELP coder, the excitation codebook is a virtual set (in the sense that it is not stored), generated algebraically. In response to an index k, k varying from 0 to K−1, the algebraic code generator produces a code vector of L samples having very few non-zero components. Let N be the number of non-zero components. In certain applications the dimension of the code words is extended to L+N, and the last N components are zero. Here it is assumed, without affecting the generality of the account, that L is a multiple of N. The code words $c_k$ are therefore made up of N pulses. The amplitudes of the pulses are fixed (for example ±1). The permitted positions for pulse p are of the form $$pos_{i,p}=Ni+p \tag{1}$$

i ranging from 0 to L'−1, where L'=L/N. In the case where L'=(L+N)/N, the position may be greater than or equal to L, and the corresponding pulse is then simply zeroed. The index of the waveform $c_k$ is obtained directly through the relation $$k=\sum_{p=0}^{N-1}(L')^p\cdot\left(\frac{pos_{i,p}-p}{N}\right)$$

and the size of the codebook is: $K=(L')^N$.

The selection of a waveform from a CELP codebook is done by searching for the one which minimizes the quadratic error between the weighted original signal and the weighted synthetic signal. This amounts to maximizing the quantity $Cr_k=P_k^2/\alpha_k^2$, where $P_k=(D\cdot c_k^T)$, and $\alpha_k^2=|c_k\cdot H^T|^2=(c_k\cdot U\cdot c_k^T)$, and $(\cdot)^T$ denotes matrix transposition. D is a target vector which depends on the input signal, on the past synthetic signal and on the compound filter made up of the synthesis and perceptual weighting filters. Let h be the vector of the impulse response of this compound filter:

$$h=(h(0),h(1), \ldots , h(L-1))$$

H is the L×L lower triangular Toeplitz matrix formed from this impulse response. $U=H^T \cdot H$ is the covariance matrix of h. Denoting by U(i,j) the element of the matrix U in row i and in column j ($0 \leqq i,j<L$), the element U(i, j) is equal to:

$$U(i,j)=\sum_{n=\max(i,j)}^{L-1} h(n-i) \cdot h(n-j)$$

In an ACELP coder, if the waveform $c_k$ is composed of N pulses with positions $pos_{i(q,k),q}$ and amplitude $S_q$ ($0 \leqq q<N$), the scalar product $P_k$ of the target vector D with a waveform $c_k$ and the energy $\alpha_k^2$ of the filtered waveform $c_k$ have the expressions:

$$P_k=\sum_{q=0}^{N-1} S_q \cdot D(pos_{i(q,k),q})$$

and $$\alpha_k^2=\sum_{p=0}^{N-1} S_p^2 \cdot U(pos_{i(p,k),p}, pos_{i(p,k),p}) + 2 \cdot \sum_{p=0}^{N-2} \sum_{q=p+1}^{N-1} S_p \cdot S_q \cdot U(pos_{i(p,k),p}, pos_{i(q,k),q})$$

One of the advantages of the ACELP codebook is that it gives rise to an effective sub-optimal method of selecting the best waveform. This search is performed by nesting the loops for searching for the pulses. For a loop of order q, the index $i_q=(pos_{i,q}-q)/N$ which codes the position varies within the set [0, . . . , L'−1]. Exploration is accelerated by calculating an adaptive threshold for each loop, before entering the search procedure. The search loop for pulse q is entered only if a partial quantity $Cr_k(q-1)$, calculated from the pulses 0 to q−1 determined previously in the higher loops, exceeds a threshold calculated for loop q−1. The partial quantity may be: $Cr_k(q-1)=P_k^2(q-1)/\alpha_k^2(q-1)$ or $Cr_k(q-1)=P_k^2(q-1)$, where $\alpha_k^2(q-1)$ is the energy of the compound waveform of pulses 0 to q−1 of $c_k$ filtered, and $P_k(q-1)$ is the scalar product of the target vector D with the compound waveform of pulses 0 to q−1 of $c_k$.

Calculation of the partial criteria is simplified through the recursive character of $P_k(q)$ and $\alpha_k^2(q)$. Indeed, the sequences $\{P_k(q)\}_{q=0, \ldots , N-1}$ and $\{\alpha_k^2(q)\}_{q=0, \ldots , N-1}$ are calculated recursively as follows:

$$P_k(0)=S_0 D(pos_{i(0,k),0}) \text{ and } P_k(q)=P_k(q-1)+S_q \cdot D(pos_{i(q,k),q})$$

$$\alpha_k^2(0)=S^2_0 \cdot U(pos_{i(0,k),0}, pos_{i(0,k),0}) \text{ and}$$

$$\alpha_k^2(q) = \alpha_k^2(q-1) + s_q^2 \cdot U(pos_{i(q,k),q}, pos_{i(q,k),q}) + \sum_{p=0}^{q-1} S_p \cdot S_q \cdot U(pos_{i(p,k),p}, pos_{i(q,k),q})$$

where $pos_{i(p,k),p}$ is the position of the p-th pulse of $c_k$ and $S_p$ its amplitude. The energy $\alpha_k^2$ of the filtered waveform $c_k$ and the scalar product $P_k$ of $c_k$ and the target vector D are obtained at the completion of the recursion (q=N−1).

Calculation of the K sequences $\{\alpha_k^2(q)\}_{q=0, \ldots , N-1}$, for k varying from 0 to K−1, requires a knowledge of the elements of the covariance matrix U of the impulse response h of the compound filter. In the earlier ACELP coder all the elements U(i,j) of the matrix U are calculated and stored. The matrix U possesses the following properties which are used when calculating its $L^2$ elements:

symmetry property:

$$U(i,j)=U(j,i), \text{ for } 0 \leqq i,j<L$$

recursion property on the diagonals:

$$U(i-1,j-1)=U(i,j)+h(L-i) \cdot h(L-j), \text{ for } 0<i,j<L$$

and $$U(i,L-1)=U(L-1,i)=h(0) \cdot h(L-1-i), \text{ for } 0 \leqq i<L$$

However, calculation of the matrix U exploiting these two properties to the maximum, still requires:

L(L+1)/2 multiplications and L(L−1)/2 additions, $L^2$ memory loadings.

In conclusion, the ACELP technique requires a large number of memory loadings and a memory of substantial size. It is in fact necessary to store:

the input signal (typically 80 to 360 words of 16 bits), the covariance matrix ($40^2$ to $60^2$ words of 16 bits), the intermediate signals and their memories (typically 2 to 3K words of 16 bits), the output signal (typically 80 to 200 words or bytes).

It is clearly apparent that the size of the covariance matrix takes up the greatest room. It is noted that, for a given application, the memory space required for the intermediate signals cannot be compressed; if it is wished to reduce the overall memory size, it seems therefore that it is possible only to alter the size of the memory required for the covariance matrix. However, hitherto, the experts knew that this matrix was symmetric with respect to the principal diagonal and that certain terms were not useful, but they thought that the latter were arranged in the matrix without any determined order.

A first idea for decreasing the memory space required for the covariance matrix relied on exploiting the symmetry property of this matrix. However, experience has shown that storing half the matrix entails more complicated address computations when searching for the ACELP excitation, an already very complex module (typically 50% of the CPU type). The memory saving then lost any benefit faced with the rise in complexity.

A principal purpose of the present invention is to propose a coding method of ACELP type which substantially reduces the size of the memory required by the coder.

SUMMARY OF THE INVENTION

The invention thus proposes a code-excited linear prediction (CELP) speech coding method, comprising the steps of: digitizing a speech signal as successive frames of L samples; adaptively determining on the one hand synthesis parameters defining synthesis filters, and on the other hand excitation parameters including, for each frame, pulse positions in an excitation code of L samples belonging to a predetermined algebraic codebook and an associated excitation gain; and transmitting quantization values representative of the determined parameters. The algebraic codebook is defined on the basis of at least one group of N sets of possible pulse positions in codes of at least L samples, a code from the codebook being represented by N pulse positions belonging respectively to the N sets of a group. The determination of the excitation parameters relating to a frame includes selecting a code from the codebook which maximizes the quantity $P_k^2/\alpha_k^2$ in which $P_k=D\cdot c_k^T$ denotes the scalar product of a code $c_k$ from the codebook and a target vector D depending on the speech signal of the frame and on the synthesis parameters, and $\alpha_k^2$ denotes the energy in the frame of the code $c_k$ filtered by a compound filter made up of the synthesis filters and of a perceptual weighting filter. The calculation of the energies $\alpha_k^2$ includes a calculation and memory-storage of components of a covariance matrix $U=H^T\cdot H$ where H denotes a lower triangular Toeplitz matrix with L rows and L columns, formed from the impulse response h(0), h(1), . . . , h(L−1) of said compound filter. The memory-stored components of the covariance matrix are only, for at least one group of N sets, those of the form:

$$U(pos_{i,p},pos_{i,p})=\sum_{n=pos_{i,p}}^{L-1}[h(n-pos_{i,p})]^2$$

with $0\leqq p<N$ and those of the form:

$$U(pos_{i,p},pos_{j,q})=\sum_{n=\max(pos_{i,p},pos_{j,q})}^{L-1}h(n-pos_{i,p})h(n-pos_{j,q})$$

with $0\leqq p<q<N$, $pos_{i,p}$ and $pos_{j,q}$ respectively denoting the positions of order i and j in the sets of said group containing possible positions for the pulses p and q of the codes from the codebook.

In this way, only the terms actually used when searching for the ACELP excitation are stored, thus enabling the necessary memory to be considerably reduced. For example, in the case in which the algebraic codebook has the structure (1) defined above with a single group of N sets, the number of elements in the matrix U to be stored is $L+L^2(N-1)/2N$ instead of $L^2$ in the case of the earlier ACELP coder, so that the reduction in memory space is $[L^2(N+1)/2N]-L$ words of random access memory, namely several kilobytes for the usual values of L and N.

Preferably, the memory-stored components of the covariance matrix are structured, for a group, in the form of N correlation vectors and N(N−1)/2 correlation matrices. Each correlation vector $R_{p,p}$ is associated with a pulse number p in the codes from the codebook ($0\leqq p<N$) and is of dimension $L_p'$ equal to the cardinal of the set from said group containing possible positions for the pulse p, with components i ($0\leqq i<L_p'$) of the form $R_{p,p}(i)=U(pos_{i,p},pos_{i,p})$. Each correlation matrix $R_{p,q}$ is associated with two different pulse numbers p,q in the codes from the codebook ($0\leqq p<q<N$) and has $L_p'$ rows and $L_q'$ columns, with components of the form $R_{p,q}(i,j)=U(pos_{i,p},pos_{j,q})$ in row i and in column j ($0\leqq i<L_p'$ and $0\leqq j<L_q'$). This way of arranging the components of the covariance matrix facilitates access thereto when searching for the ACELP excitation, so as to reduce or at least not increase the complexity of this module.

The method according to the invention is applicable to various types of algebraic codes, that is to say irrespective of the structure of the sets of possible positions for the various pulses of the codes from the codebook. The procedure for calculating the correlation vectors and correlation matrices can be made relatively simple and effective if, in a group of N sets, the sets of possible positions for a pulse of the codes from the codebook all have the same cardinal L' and if the position of order i in the set of the possible positions for the pulse p ($0\leqq i<L'$, $0\leqq p<N$) is given by:

$$pos_{i,p}=\delta\cdot(iN+p)+\epsilon,$$

δ and ϵ being two integers such that $\delta>0$ and $\epsilon\geqq 0$.

DESCRIPTION OF PREFERRED EMBODIMENTS

Figure 1:
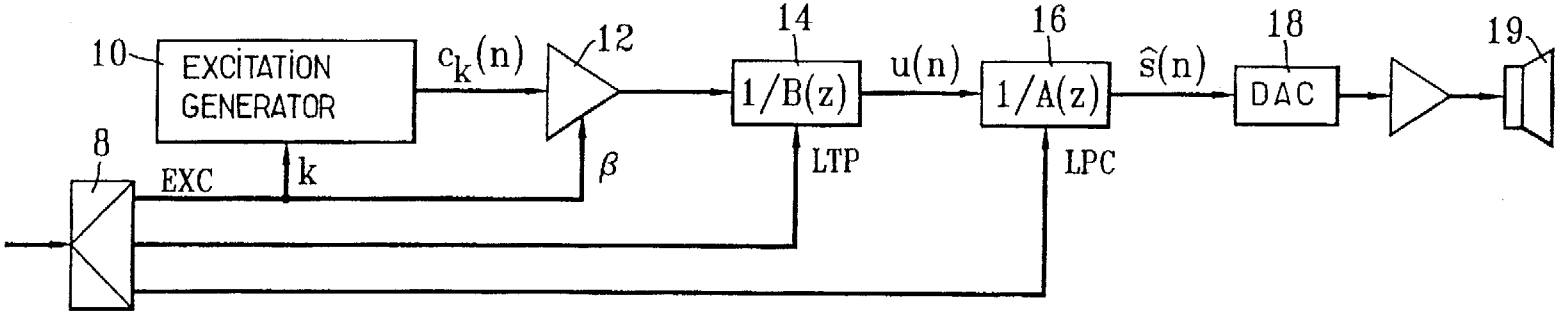
FIGS. 1 and 2 are schematic layouts of a CELP decoder and of a CELP coder using an algebraic codebook in accordance with the invention.

The speech synthesis process implemented in a CELP coder and a CELP decoder is illustrated in FIG. 1. An excitation generator 10 delivers an excitation code $c_k$ belonging to a predetermined codebook in response to an index k. An amplifier 12 multiplies this excitation code by an excitation gain β, and the resulting signal is subjected to a long-term synthesis filter 14. The output signal u from the filter 14 is in turn subjected to a short-term synthesis filter 16, the output ŝ from which constitutes what is here regarded as the synthesized speech signal. Of course, other filters may also be implemented at decoder level, for example post-filters, as is well known in the field of speech coding.

The aforesaid signals are digital signals represented for example by 16-bit words at a sampling rate Fe equal for example to 8 kHz. The synthesis filters 14, 16 are in general purely recursive filters. The long-term synthesis filter 14 typically has a transfer function of the form 1/B(z) with $B(z)=1-Gz^{-T}$. The delay T and the gain G constitute long-term prediction (LTP) parameters which are determined adaptively by the coder. The LPC parameters of the short-term synthesis filter 16 are determined at the coder by linear prediction of the speech signal. The transfer function of the filter 16 is thus of the form 1/A(z) with $$A(z)=1-\sum_{i=1}^{P}a_iz^{-i}$$

in the case of linear prediction of order P (typically P≈10), $a_i$ representing the ith linear prediction coefficient.

Figure 2:
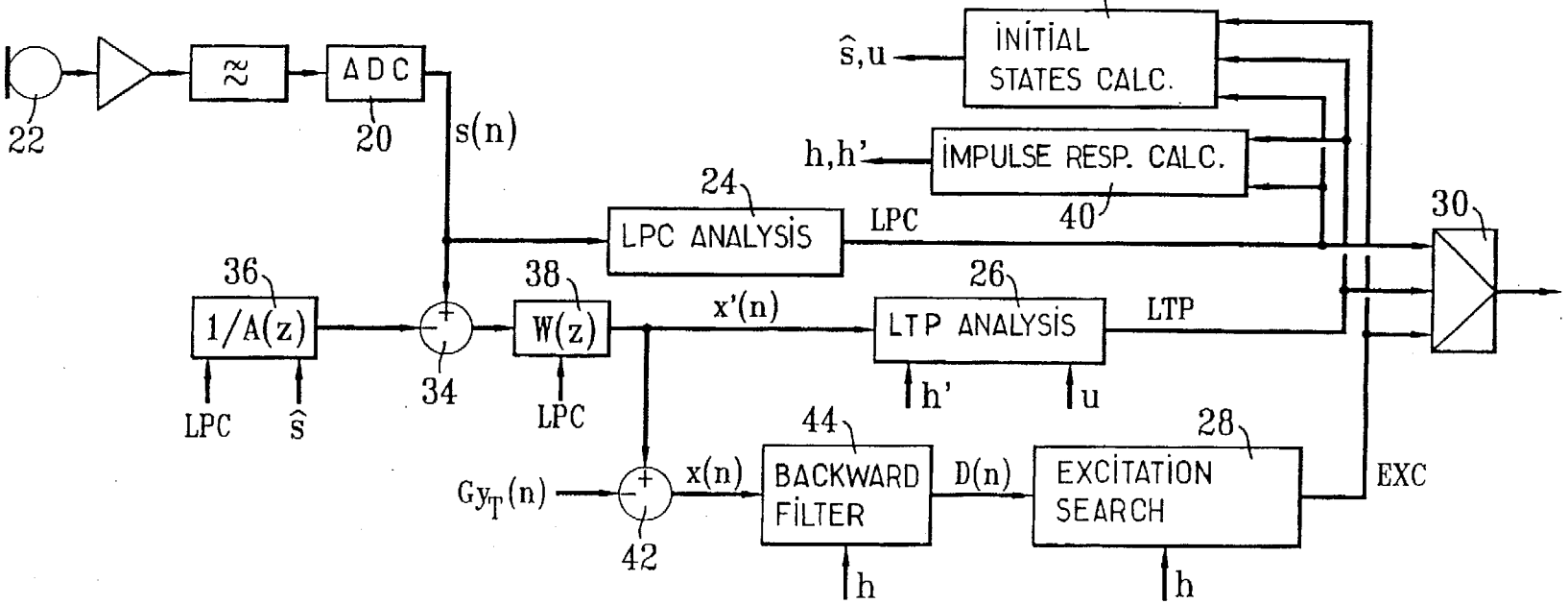

FIG. 2 shows the layout of a CELP coder. The speech signal s(n) is a digital signal, for example provided by an analogue/digital converter 20 which processes the amplified and filtered output signal of a microphone 22. The signal s(n) is digitized as successive frames of Λ samples which are themselves divided into sub-frames, or excitation frames, of L samples (for example Λ=240, L=40).

The LPC, LTP and EXC parameters (index k and excitation gain β) are obtained at coder level by three respective analysis modules 24, 26, 28. These parameters are next quantized in a known manner with a view to effective digital transmission, then subjected to a multiplexer 30 which forms the output signal from the coder. These parameters are also supplied to a module 32 for calculating initial states of certain filters of the coder. This module 32 essentially comprises a decoding chain such as that represented in FIG. 1. The module 32 affords a knowledge, at coder level, of the earlier states of the synthesis filters 14, 16 of the decoder, which are determined on the basis of the synthesis and excitation parameters prior to the sub-frame under consideration.

In a first step of the coding process, the short-term analysis module 24 determines the LPC parameters (coefficients $a_i$ of the short-term synthesis filter) by analysing the short-term correlations of the speech signal s(n). This determination is performed for example once per frame of Λ samples, in such a way as to adapt to the changes in the spectral content of the speech signal. LPC analysis methods are well known in the art, and will therefore not be detailed here. Reference may for example be made to the work "Digital Processing of Speech Signals" by L. R. Rabiner and R. W. Sharer, Prentice-Hall Int., 1978.

The next step of the coding consists in determining the long-term prediction LTP parameters. These are for example determined once per sub-frame of L samples. A subtracter 34 subtracts the response of the short-term synthesis filter 16 to a null input signal from the speech signal s(n). This response is determined by a filter 36 with transfer function 1/A(z), the coefficients of which are given by the LPC parameters which were determined by the module 24, and the initial states $\hat{s}$ of which are provided by the module 32 in such a way as to correspond to the last P samples of the synthetic signal. The output signal from the subtracter 34 is subjected to a perceptual weighting filter 38. The transfer function W(z) of this perceptual weighting filter is determined from the LPC parameters. One possibility is to take W(z)=A(z)/A(z/γ), where γ is a coefficient of the order of 0.8. The role of the perceptual weighting filter 38 is to emphasize the portions of the spectrum in which the errors are most perceptible.

The closed-loop LTP analysis performed by the module 26 consists, in a conventional manner, in selecting for each sub-frame the delay T which maximizes the normalized correlation:

$$\left[\sum_{n=0}^{L-1} x'(n)\cdot y_T(n)\right]^2 / \left[\sum_{n=0}^{L-1} [y_T(n)]^2\right]$$

where x' (n) denotes the output signal from the filter 38 during the relevant sub-frame, and $y_T(n)$ denotes the convolution product u(n–T)*h'(n). In the above expression, h'(0), h'(1), . . . , h'(L–1) denotes the impulse response of the weighted synthesis filter, with transfer function W(z)/A(z). This impulse response h' is obtained by a module 40 for calculating impulse responses, on the basis of the LPC parameters which were determined for the sub-frame. The samples u(n–T) are the earlier states of the long-term synthesis filter 14, as provided by the module 32. In respect of the delays T which are less than the length of a sub-frame, the missing samples u(n–T) are obtained by interpolation on the basis of the earlier samples, or from the speech signal. The delays T, integer or fractional, are selected from a specified window, ranging for example from 20 to 143 samples. To reduce the closed-loop search range, and hence to reduce the number of convolutions $y_T(n)$ to be calculated, it is possible firstly to determine an open-loop delay $T_1$ for example once per frame, and then to select the closed-loop delays for each sub-frame in a reduced interval around $T_1$. The open-loop search consists more simply in determining the delay $T_1$ which maximizes the autocorrelation of the speech signal s(n), possibly filtered by the inverse filter with transfer function A(z). Once the delay T has been determined, the long-term prediction gain G is obtained through:

$$G = \left[\sum_{n=0}^{L-1} x'(n)\cdot y_T(n)\right] / \left[\sum_{n=0}^{L-1} [y_T(n)]^2\right]$$

In order to search for the CELP excitation relating to a sub-frame, the signal $Gy_T(n)$, which was calculated by the module 26 in respect of the optimal delay T, is firstly subtracted from the signal x'(n) by the subtracter 42. The resulting signal x(n) is subjected to a backward filter 44 which provides a signal D(n) given by:

$$D(n) = \sum_{i=n}^{L-1} x(i)\cdot h(i-n)$$

where h(0), h(1), . . . , h(L–1) denotes the impulse response of the compound filter made up of the synthesis filters and of the perceptual weighting filter, this response being calculated by the module 40. In other words, the compound filter has transfer function W(z)/[A(z)·B(z)]. In matrix notation, we therefore have:

$$D=(D(0), D(1), \ldots, D(L-1))=x\cdot H$$

$$\text{with } x=(x(0), x(1), \ldots, x(L-1))$$

$$\text{and } H=\begin{pmatrix} h(0) & 0 & \cdots & 0 \\ h(1) & h(0) & & \cdot \\ \cdot & \cdot & & \cdot \\ \cdot & \cdot & & \cdot \\ h(L-2) & \cdot & h(0) & 0 \\ h(L-1) & h(L-2) & \cdots\ h(1) & h(0) \end{pmatrix}$$

The vector D constitutes a target vector for the excitation search module 28. This module 28 determines a codeword from the codebook which maximizes the normalized correlation $P_k^2/\alpha_k^2$ in which:

$$P_k=D\cdot c_k^T$$

$$\alpha_k^2=c_k\cdot H^T\cdot H\cdot c_k^T=c_k\cdot U\cdot c_k^T$$

The optimal index k having been determined, the excitation gain β is taken equal to $\beta=P_k/\alpha_k^2$.

The algebraic codebook of possible excitation codes is defined on the basis of at least one group of N sets $E_0, E_1, \ldots, E_{N-1}$ of possible positions for pulses of order 0, 1, . . . , N–1 and of amplitude $S_0, S_1, \ldots, S_{N-1}$ in codes of at least L samples. A code from the codebook is represented by N pulse positions belonging respectively to the sets $E_0, E_1, \ldots, E_{N-1}$ of one and the same group of N sets. In the general case, the cardinals $L'_0, L'_1, \ldots, L'_{N-1}$ of the sets $E_0, E_1, \ldots, E_{N-1}$ may be equal or different, and these sets may or may not be disjoint.

In the first embodiment below, it will be assumed that there is a single group whose N sets $E_0, E_1, \ldots, E_{N-1}$ all have the same cardinal L', and that the position of order i in the set $E_p$ of the possible positions for the pulse p ($0 \leqq i < L'$, $0 \leqq p < N$) is given by:

$$pos_{i,p}=\delta\cdot(iN+p)+\epsilon, \quad (2)$$

δ and ε being two integers such that $0 \leqq \epsilon < \delta$.

After having calculated and stored in memory certain terms of the covariance matrix U, the module 28 searches for the excitation code in respect of the current sub-frame. The memory-stored components of the covariance matrix are on the one hand those of the form:

$$U(pos_{i,p},pos_{i,p}) = \sum_{n=pos_{i,p}}^{L-1} [h(n-pos_{i,p})]^2 = R_{p,p}(i)$$

structured in the form of N correlation vectors $R_{p,p}$ ($0 \leqq p < N$) with L' components, and on the other hand those of the form:

$$U(pos_{i,p},pos_{j,q}) = \sum_{n=\max(pos_{i,p},pos_{j,q})}^{L-1} h(n-pos_{i,p})h(n-pos_{j,q}) = R_{p,q}(i,j)$$

structured in the form of N(N−1)/2 correlation matrices $R_{p,q}$ ($0 \leqq p < q < N$) with L' rows and M' columns.

Figure 3:
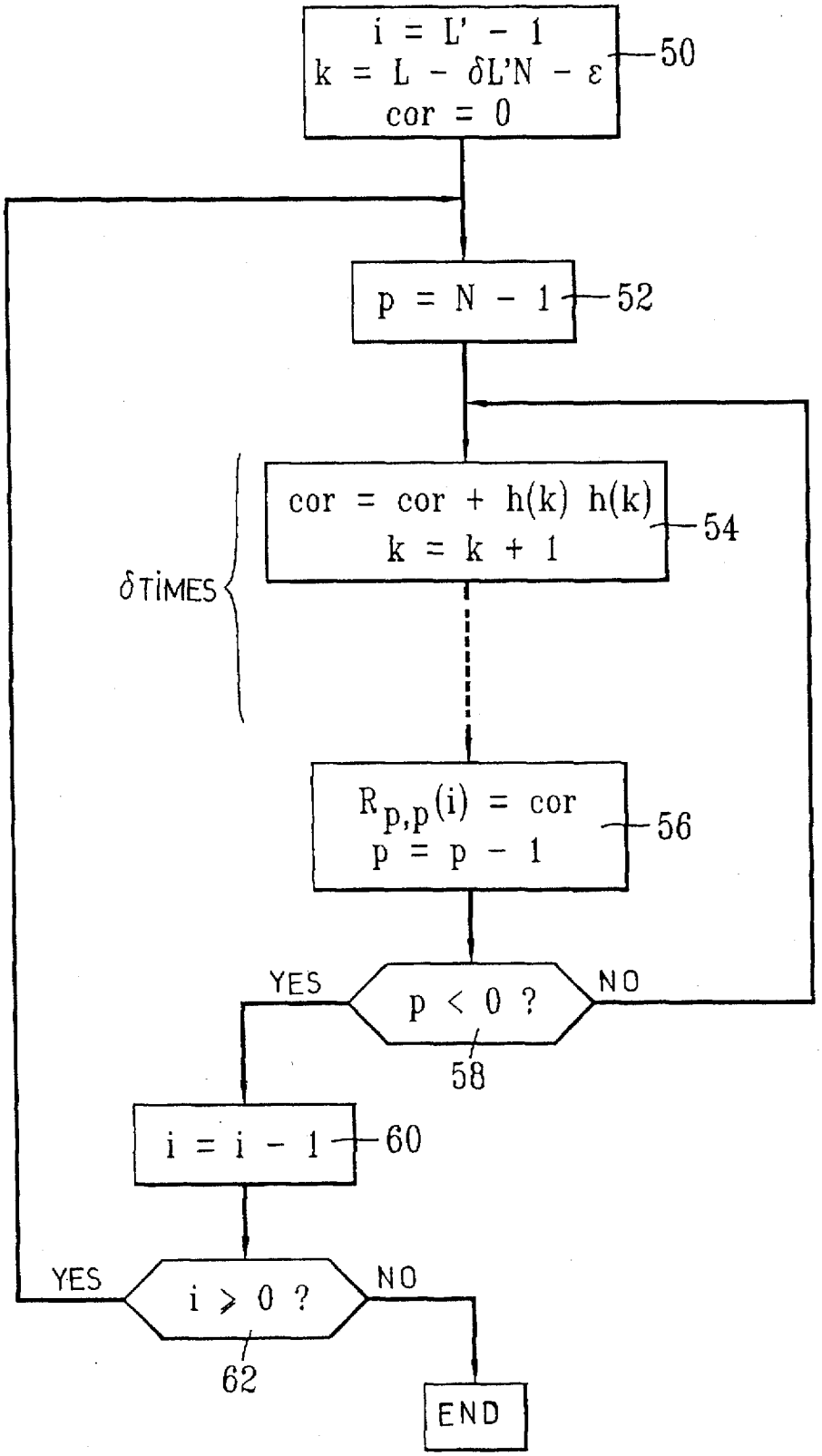
FIGS. 3 and 4 are flowcharts illustrating the calculation of the correlation vectors and correlation matrices in a first embodiment of the invention.

Calculation of the N correlation vectors $R_{p,p}$ is performed by the module 28 in the manner illustrated in FIG. 3. This calculation comprises a loop indexed by an integer i decreasing from L'−1 to 0. On initializing 50 this loop, the integer variable k is taken equal to L−δL'N−ϵ (here we assume L−δL'N−ϵ≦0), and the accumulation variable cor is taken equal to 0. In iteration i of the loop, the components $R_{p,p}(i)$ are calculated successively for p decreasing from N−1 to 0. The variable p is firstly taken equal to N−1 (step 52). The instructions cor=cor+h(k)·h(k) and k=k+1 (step 54) are performed δ times (if L−δL'N−ϵ<0, the terms h(k) with k<0 are taken equal to 0). Next (step 56), the component $R_{p,p}(i)$ is taken equal to the accumulation variable cor, and the integer p is decremented by one unit. The test 58 is then performed on the integer variable p. If p≧0, we return to step 54 for δ executions of the corresponding instructions. If the test 58 shows that p<0, the integer variable i is decremented by one unit (step 60), and then compared with 0 in the test 62. If i≧0, we return before step 52 so as to perform the next iteration in the loop. Calculation of the N correlation vectors is terminated when the test 62 shows that i<0.

This calculation of the N correlation vectors requires of the order of δL'N additions, δL'N multiplications and L'N memory loadings. It will be observed that initialization 50 of the calculation could be different. For example, the integer k can equally be initialized to L−δL'N in step 50, each iteration in the loops indexed by p decreasing from N−1 to 0 then consisting of δ−ϵ executions of step 54, followed by step 56 followed by ϵ executions of step 54. The calculation remains correct because in total δ steps 54 are performed between two successive memory storages of terms $R_{p,p}(i)$.

Figure 4:
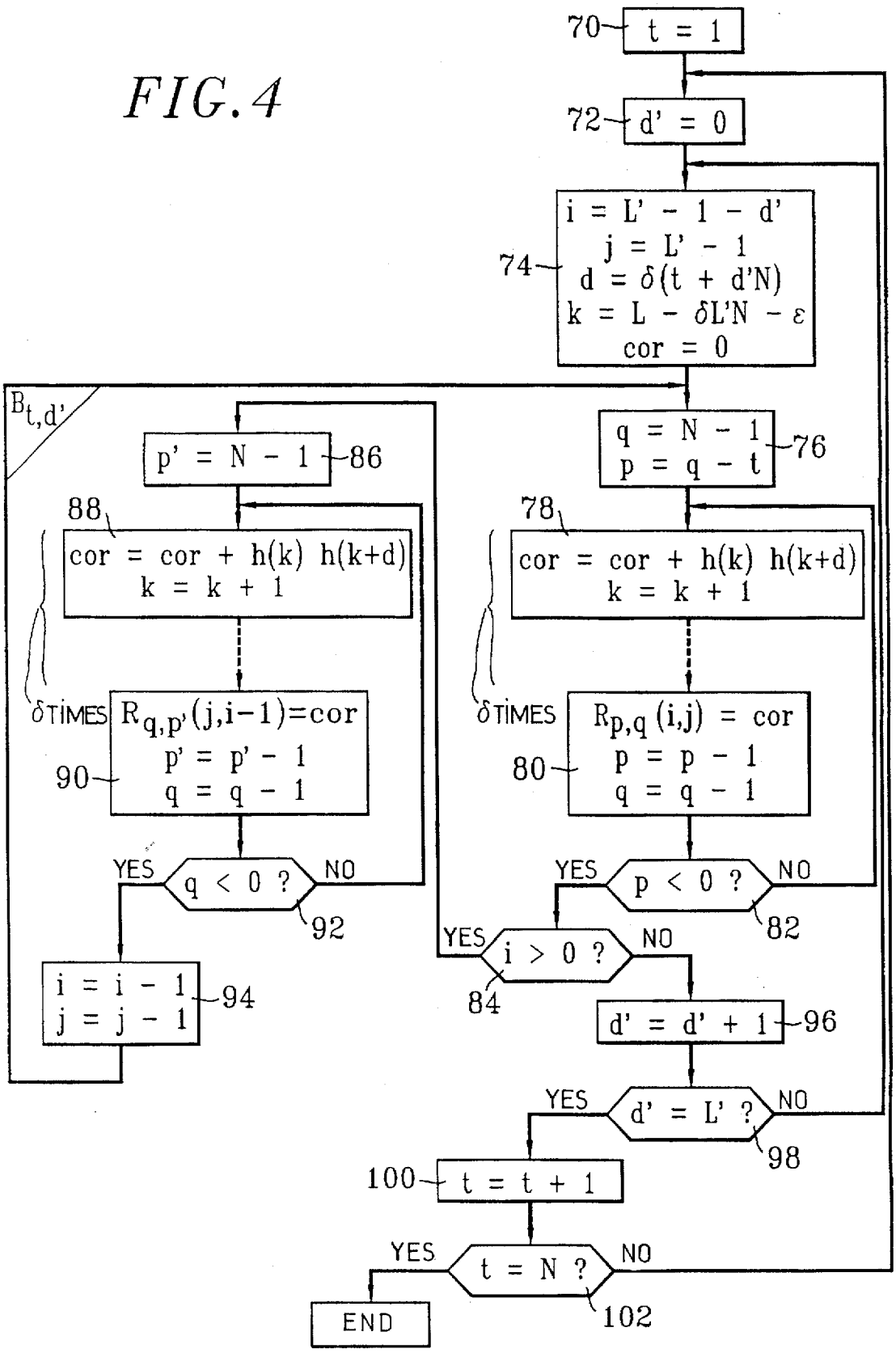

The calculation of the N(N−1)/2 correlation matrices $R_{p,q}$ can be performed by the module 28 in the manner illustrated in FIG. 4. For each value of the integer t lying between 1 and N−1 and of the integer d' lying between 0 and L'−1, this calculation comprises a loop $B_{t,d'}$, indexed by an integer i decreasing from L'−1−d' to 0. On initializing 70 the calculation, the integer t is taken equal to 1. The integer d' is next taken equal to 0 in step 72. Step 74 corresponds to the initializing of the loop indexed by the integer i. The integer i is initialized to L'−1−d', the integer j to L'−1, the integer d to δ·(t+d'N), the integer k to L−δL'N−ϵ, and the accumulation variable cor to 0. In iteration i of the loop $B_{t,d'}$, the components $R_{p,p+t}(i,i+d')$ are calculated successively for p decreasing from N−1−t to 0 and then, if i>0, the components $R_{q,q+N-t}(i+d',i-1)$ are calculated successively for q decreasing from t−1 to 0. Iteration i commences by initializing 76 the integer variables q and p to N−1 and N−1−t respectively. Step 78 is then executed δ times, and consists in adding the term h(k)·h(k+d) to the accumulation variable cor and in incrementing the variable k by one unit. In step 80, the component $R_{p,q}(i,j)$ is taken equal to the accumulation variable cor, and the integers p and q are each decremented by one unit. The test 82 is next performed on the integer p. If p≧0, we return before step 78 which will again be executed δ times. If the test 82 shows that p<0, test 84 is performed on the integer i. If i>0, we go to step 86 where the integer p' is initialized to N−1, the integer q remaining equal to t−1. Step 86 is followed by δ successive executions of step 88 consisting, like step 78, in adding h(k)·h(k+d) to the accumulation variable cor and in incrementing the integer variable k by one unit. Next, the component $R_{q,p'}(j,i-1)$ is taken equal to the accumulation variable cor, and the integers p' and q are each decremented by one unit, in step 90. Test 92 is next performed on the value of the integer q. If q≧0, we return before step 88 which will again be executed δ times. If the test 92 shows that q<0, the integers i and j are each decremented by one unit in step 94, and then we return before step 76 for execution of the next iteration in the loop $B_{t,d'}$. This loop is terminated when the test 84 shows that i≦0. The integer d' is then incremented by one unit (step 96), then compared with the number L' (test 98). If d'<L', we return before step 74 in order to perform another loop $B_{t,d'}$ indexed by the integer i. If the test 98 shows that d'=L', the integer t is incremented by one unit (step 100), and then compared with the number N (test 102). If t<N we return before step 72 in order to calculate the components of the matrices $R_{p,p+t}$ and $R_{q,q+N-t}$ for the new value of t. The calculation of the N(N−1)/2 correlation matrices is terminated when the test 102 shows that t=N.

This calculation of the N(N−1)/2 correlation matrices requires only of the order of $\delta L'^2N(N-1)/2$ additions, $\delta L'^2N(N-1)/2$ multiplications and $L'^2N(N-1)/2$ memory loadings.

Figure 5A:
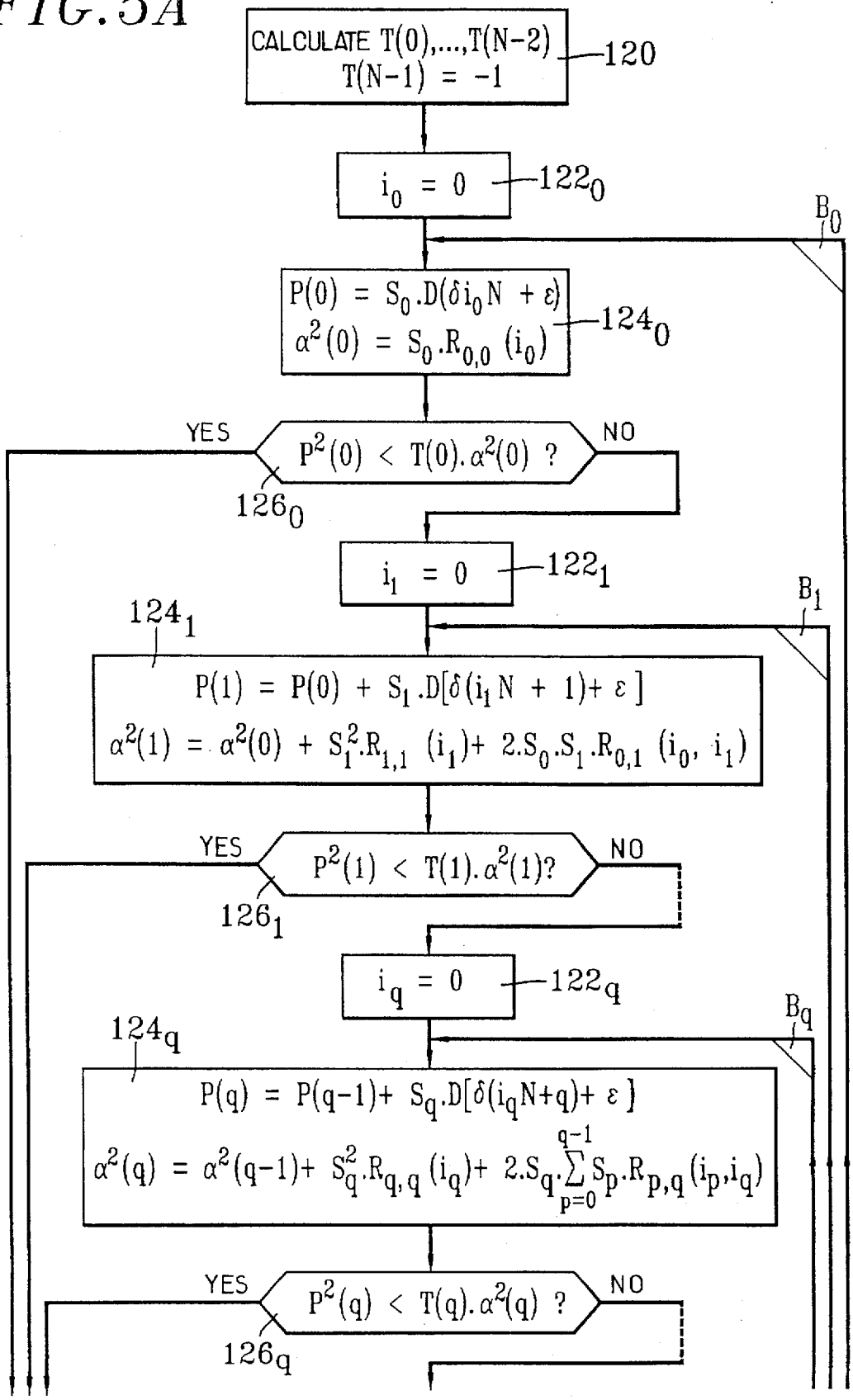
FIGS. 5A and 5B, when placed one above the other, show a flowchart of the excitation search procedure in the first embodiment.
Figure 5B:
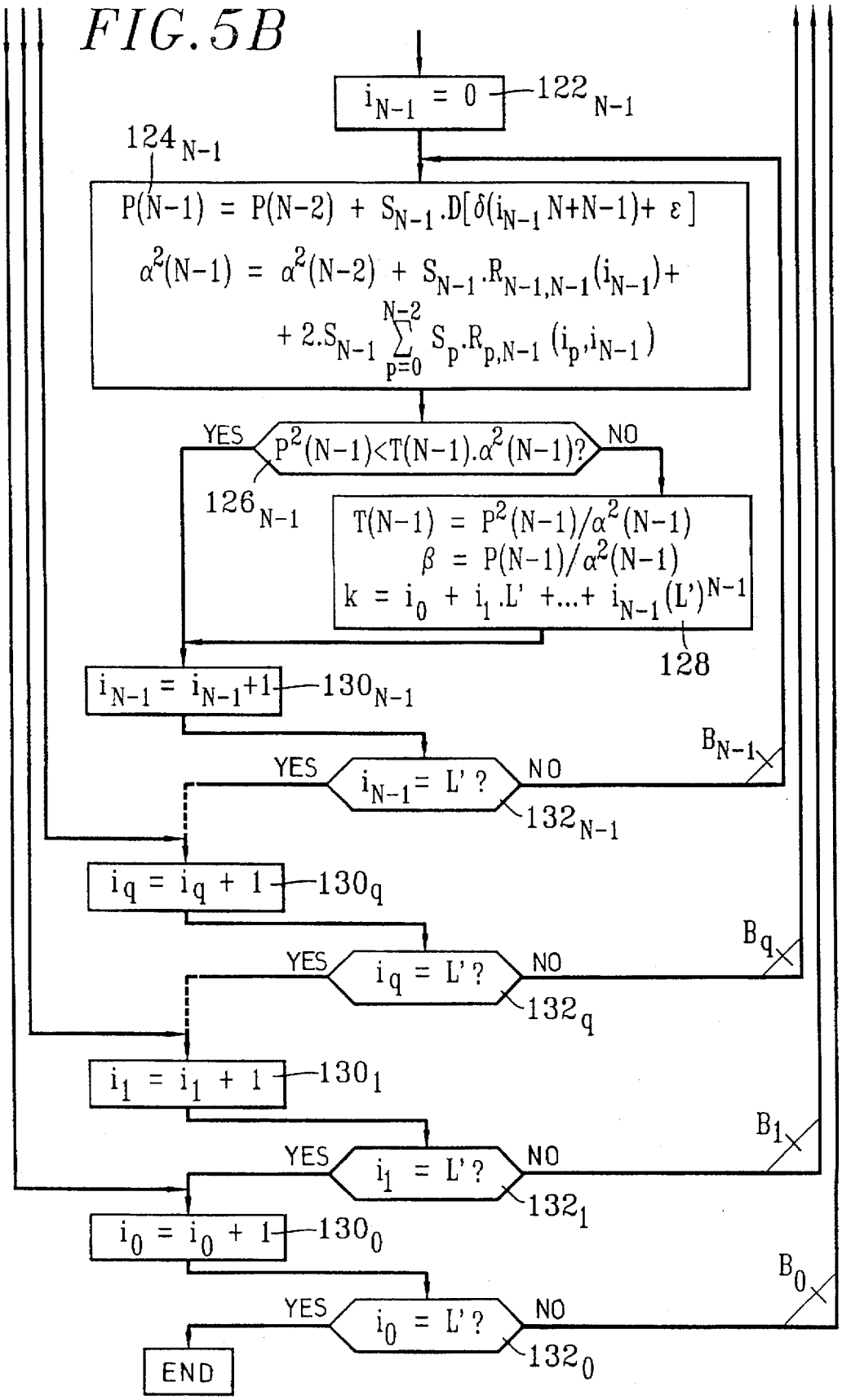

The search for the excitation code can be performed by the module 28 in accordance with the flowchart represented in FIGS. 5A and 5B. In step 120, we firstly calculate N−1 partial thresholds T(0), . . . , T(N−2), and the threshold T(N−1) is initialized to a negative value, for example −1. The partial thresholds T(0), . . . , T(N−2) are positive and calculated on the basis of the input vector D and of a compromise aiming between the efficiency of the search for the excitation and the simplicity of this search. High values of the partial thresholds tend to decrease the amount of computation required in the search for the excitation, whereas low values of the partial thresholds lead to a more exhaustive search in the ACELP codebook.

The search for the excitation code comprises N loops $B_0$, $B_1, \ldots, B_{N-1}$ nested inside one another. On initializing $\mathbf{122}_0$ the loop $B_0$, the index $i_0$ is taken equal to 0. The iteration of index $i_0$ in the loop $B_0$ comprises a step $\mathbf{124}_0$ of calculating two terms P(0) and $\alpha^2(0)$ according to:

$$P(0)=S_0 \cdot D(\delta i_0 N+\epsilon)$$

$$\alpha^2(0)=S_0 \cdot R_{0,0}(i_0)$$

A comparison $\mathbf{126}_0$ is then made between the quantities $P^2(0)$ and $T(0)\cdot\alpha^2(0)$. If $P^2(0)<T(0)\cdot\alpha^2(0)$, then we go to step $\mathbf{130}_0$ for incrementing the index $i_0$ and then to the test $\mathbf{132}_0$ in which the index $i_0$ is compared with the number L'. When $i_0$ becomes equal to L', the search for the excitation is terminated. Otherwise, we return before step $\mathbf{124}_0$ in order to proceed with the next iteration in the loop $B_0$. If the comparison $\mathbf{126}_0$ shows that $P^2(0) \geqq T(0)\cdot\alpha^2(0)$, then the loop $B_1$ is executed. The loops $B_q$, for 0<q<N−1 are made up of identical instructions:

an initialization $122_q$, where we take $i_q=0$;

for the iteration of index $i_q$, the calculation $124_q$ of the two quantities P(q) and $\alpha^2(q)$ according to:

$$P(q)=P(q-1)+S_q\cdot D[\delta(i_qN+q)+\epsilon]$$

$$\alpha^2(q)=\alpha^2(q-1)+S_q^2\cdot R_{q,q}(i_q)+2\cdot S_q\cdot\sum_{p=0}^{q-1}S_p\cdot R_{p,q}(i_p,i_q)$$

for the iteration of index $i_q$, a comparison $126_q$ between the quantities $P^2(q)$ and $T(q)\cdot\alpha^2(q)$;

if the comparison $126_q$ shows that $P^2(q)\geqq T(q)\cdot\alpha^2(q)$, go to loop $B_{q+1}$;

if the comparison $126_q$ shows that $P^2(q)<T(q)\cdot\alpha^2(q)$, incrementation $130_q$ of the index $i_q$, then compare $132_q$ the index $i_q$ and the number L';

if the comparison $132_q$ shows that $i_q<L'$, return before step $124_q$ for the next iteration; and if the comparison $132_q$ shows that $i_q=L'$, go to step $130_{q-1}$ for incrementing the index $i_{q-1}$ of the higher loop.

The loop $B_{N-1}$ is made up of the same instructions as the preceding loops. However, if the comparison $126_{N-1}$ shows that $P^2(N-1)\geqq T(N-1)\cdot\alpha^2(N-1)$, then a step 128 is executed before going to step $130_{N-1}$ for incrementing the index $i_{N-1}$. This step 128 consists on the one hand in updating the threshold T(N−1) according to: $T(N-1)=P_2(N-1)/\alpha^2(N-1)$, and on the other hand in storing in memory the parameters relating to the code which has just been tested. These parameters comprise the excitation gain δ taken equal to $P(N-1)/\alpha^2(N-1)$, and the N indices $i_0,i_1,\ldots,i_{N-1}$ enabling the positions of the N pulses of the code to be found. The N indices $i_0,i_1,\ldots,i_{N-1}$ can be put together into a global index k given by:

$$k=\sum_{p=0}^{N-1}i_p\cdot(L')^p$$

this index k being coded over $N\cdot\log_2(L')$ bits.

It is noted that the arranging of the components as correlation matrices makes it possible, during the nested-loop search, to address the necessary components of the matrix U in respect of a loop by simple incrementation of the pointers $i_q$ by one unit, instead of having to carry out more complicated address computations as in the case of the earlier ACELP coder.

It is possible to assign several values for the amplitude of one or more pulses of the codes of the codebook. In this case, by preference the last serial numbers are allocated to the pulses in question. If there are $n_q$ possible amplitude values for pulse q, then loop $B_q$ of the flowchart of FIGS. 5A and 5B is executed $n_q$ times, each time with a different value of the amplitude $S_q$ and, furthermore, the number of times that the loop $B_q$ was executed before encountering a value greater than $P^2(N-1)/\alpha^2(N-1)$ is stored in memory. This number will also be sent to the decoder which will therefore be able to recover the amplitude $S_q$ to be applied to the corresponding pulse of the excitation code.

With reference to FIG. 1, the ACELP decoder comprises a demultiplexer 8 receiving the binary stream from the coder. The quantized values of the EXC excitation parameters and of the LTP and LPC synthesis parameters are supplied to the generator 10, to the amplifier 12 and to the filters 14, 16 in order to reconstruct the synthetic signal ŝ, which may for example be converted into analogue by the converter 18 before being amplified and then applied to a loudspeaker 19 in order to restore the original speech.

In a second embodiment of the invention, consideration is given to an algebraic codebook constructed from M groups of N sets $\{E_0^{(m)},E_1^{(m)},\ldots,E_{N-1}^{(m)}\}$ (0≦m<M) of possible positions for the pulses 0,1, . . . , N−1 of the codes. The MN sets all have the same cardinal L', and the position of order i in set $E_p^{(m)}$ of group In containing possible positions for pulse p (0≦i<L', 0≦p<N, 0≦m<M) is given by:

$$pos_{i,p}^{(m)}=\delta\cdot(iN+p)+\epsilon^{(m)} \qquad (2_m)$$

δ and $\epsilon^{(0)},\ldots,\epsilon^{(m-1)}$ being integers such that $0\leqq\epsilon^{(0)}<\ldots<\epsilon^{(M-1)}<\delta$. A code from the codebook is then characterized by a group index m and by N position indices i.

An optimal coding procedure comparable to that described previously leads to the calculation of M groups of N correlation vectors $R_{p,p}^{(m)}$ (0≦m<M, 0≦p<N):

$$R_{p,p}^{(m)}(i)=U(pos_{i,p}^{(m)},\ pos_{i,p}^{(m)}),$$

and of M groups of N(N−1)/2 correlation matrices $R_{p,q}^{(m)}$ (0≦m<M, 0≦p<q<N):

$$R_{p,q}^{(m)}(i,j)=U(pos_{i,p}^{(m)},\ pos_{j,q}^{(m)}).$$

Figure 6:
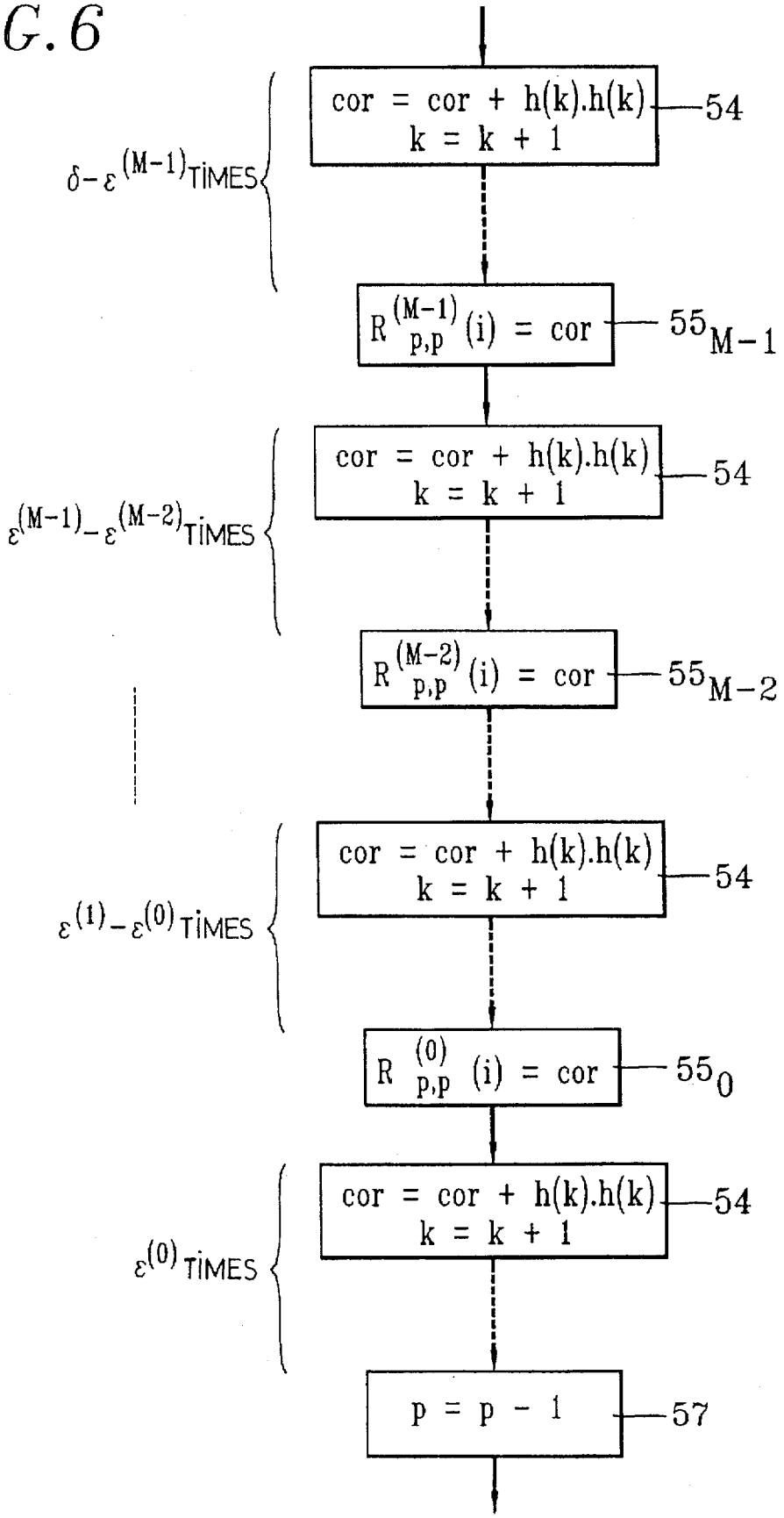
FIGS. 6 to 8 are flowcharts illustrating the calculation of the correlation vectors and correlation matrices in a second embodiment of the invention.

To calculate the components of the M groups of correlation vectors, it is possible to proceed in accordance with the flowchart of FIG. 3 with the following modifications:

the integer variable k is initialized to L−δL'N on initializing 50 the computation loop; and the δ executions of step 54 and step 56 are replaced by the sequence represented in FIG. 6: step 54 is firstly executed $\delta-\epsilon^{(M-1)}$ times before taking $R_{p,p}^{(M-1)}(i)$=cor in step $55_{M-1}$; next for m decreasing from M−2 to 0, step 54 is executed $\epsilon^{(m+1)}-\epsilon^{(m)}$ times and then we take $R_{p,p}^{(m)}(i)$=cor in step $55_m$; finally, step 54 is executed a further $\epsilon^{(0)}$ times before decrementing the integer p in step 57.

Figure 7:
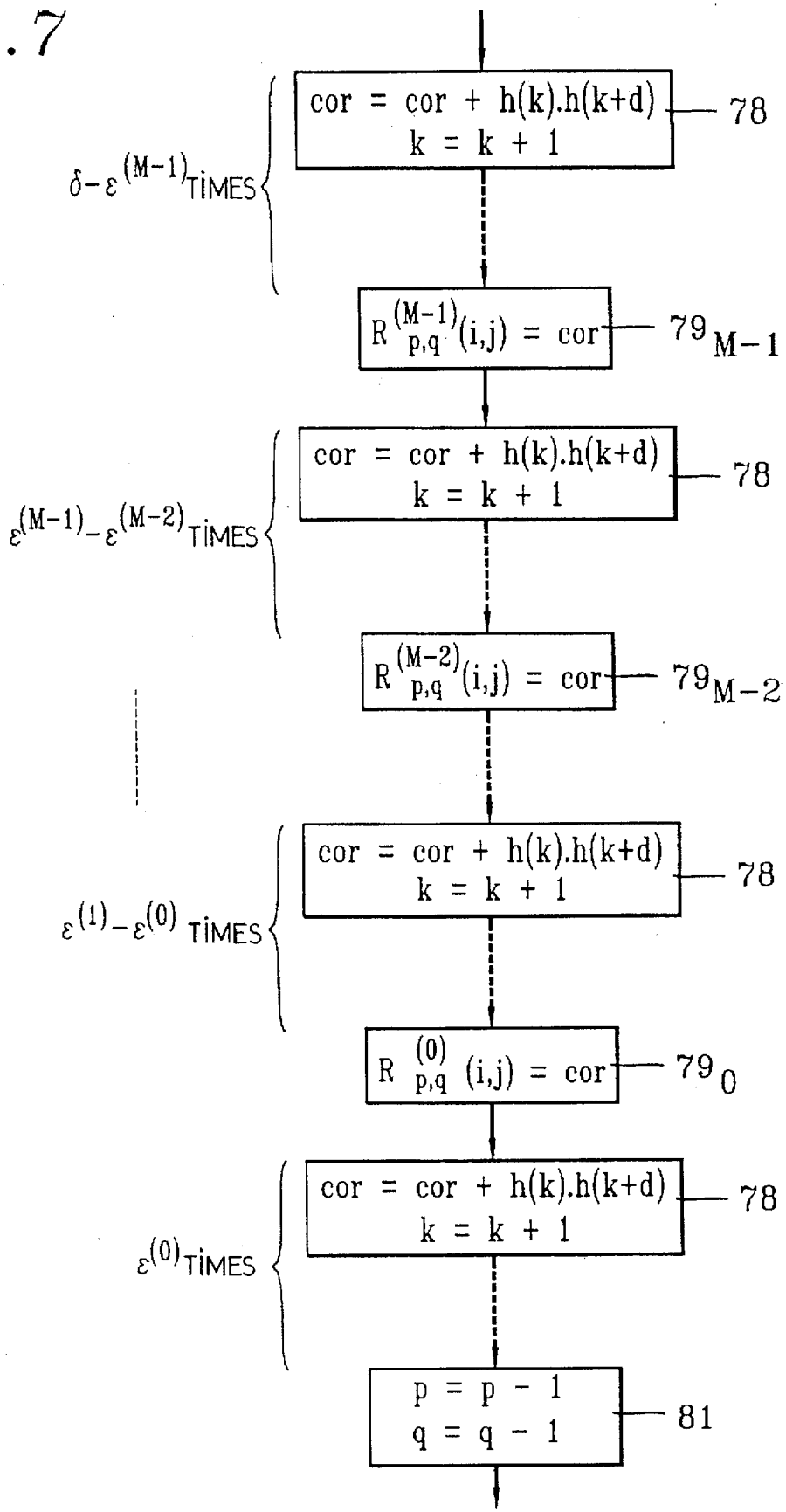
Figure 8:
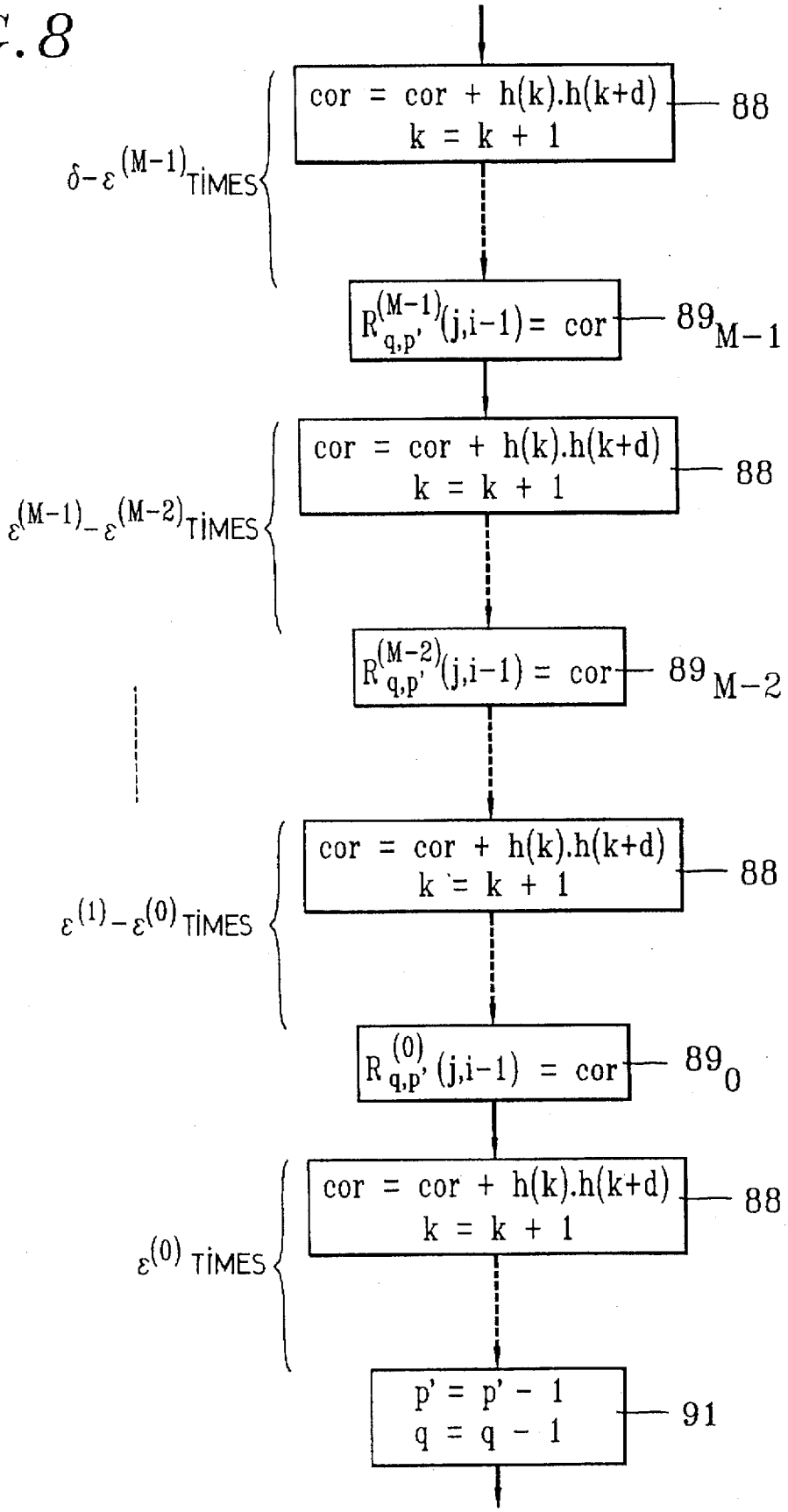

To calculate the components of the M correlation matrix groups, it is possible to proceed in accordance with the flowchart of FIG. 4 with the following modifications:

the integer variable k is initialized to L−δL'N on initializing 74 a loop $B_{s,d}$;

the δ executions of step 78 and step 80 are replaced by the sequence represented in FIG. 7: step 78 is firstly executed $\delta-\epsilon^{(M-1)}$ times before taking $R_{p,q}^{(M-1)}(i,j)$=cor in step $79_{M-1}$; next for m decreasing from M−2 to 0, step 78 is executed $\epsilon^{(m+1)}-\epsilon^{(m)}$ times and then we take $R_{p,q}^{(m)}(i,j)$=cor in step $79_m$; finally, step 78 is executed a further $\epsilon^{(0)}$ times before decrementing the integers p and q in step 81; and the δ executions of step 88 and step 90 are replaced by the sequence represented in FIG. 8: step 88 is firstly executed $\delta-\epsilon^{(M-1)}$ times before taking $R_{q,p'}^{(M-1)}(j,i-1)$ =cor in step $89_{M-1}$; next for m decreasing from M−2 to 0, step 88 is executed $\epsilon^{(m+1)}-\epsilon^{(m)}$ times and then we take $R_{q,p'}^{(m)}(j,i-1)$=cor in step $89_m$; finally, step 88 is executed a further $\epsilon^{(0)}$ times before decrementing the integers p' and q in step 91.

Once the correlation vectors and correlation matrices have been calculated, the search for the excitation can be performed simply by executing the nested-loop search represented in FIGS. 5A and 5B once for each of the M groups. It is then sufficient to store in memory, in step 128, the number of times that the nested-loop search was fully executed before the current search to obtain the index m of the group allowing reconstruction of the excitation code selected.

It is therefore understood that the second embodiment generalizes the first which corresponds to the particular case M=1.

The second embodiment with M>1 makes it possible however to implement a sub-optimal search procedure which achieves further large savings in memory space. This procedure consists in storing in memory the correlation vectors $R_{p,p}^{(m)}$ and the correlation matrices $R_{p,q}^{(m)}$ only for μ of the group indices m ($1 \leqq \mu < M$). The extra saving in memory space is then by a factor μ/M. This procedure amounts to subdividing the covariance matrix U into sub-blocks with the approximation $U(i,j) \approx U(i-1,j-1)$ within each sub-block. If the number of pulses N is large, it will be beneficial not to take too small a value of the ratio μ/M so as not to impair the quality of the coding too much. Adjustment of the numbers μ and M makes it possible to determine a compromise between the quality of coding and the necessary memory space.

When this sub-optimal procedure is implemented, steps $\mathbf{55}_m$, $\mathbf{79}_m$ and $\mathbf{89}_m$ (FIGS. 6 to 8) are bypassed in respect of those indices m for which the correlation vectors $R_{p,p}^{(m)}$ and the correlation matrices $R_{p,q}^{(m)}$ are not stored in memory.

Figure 9:
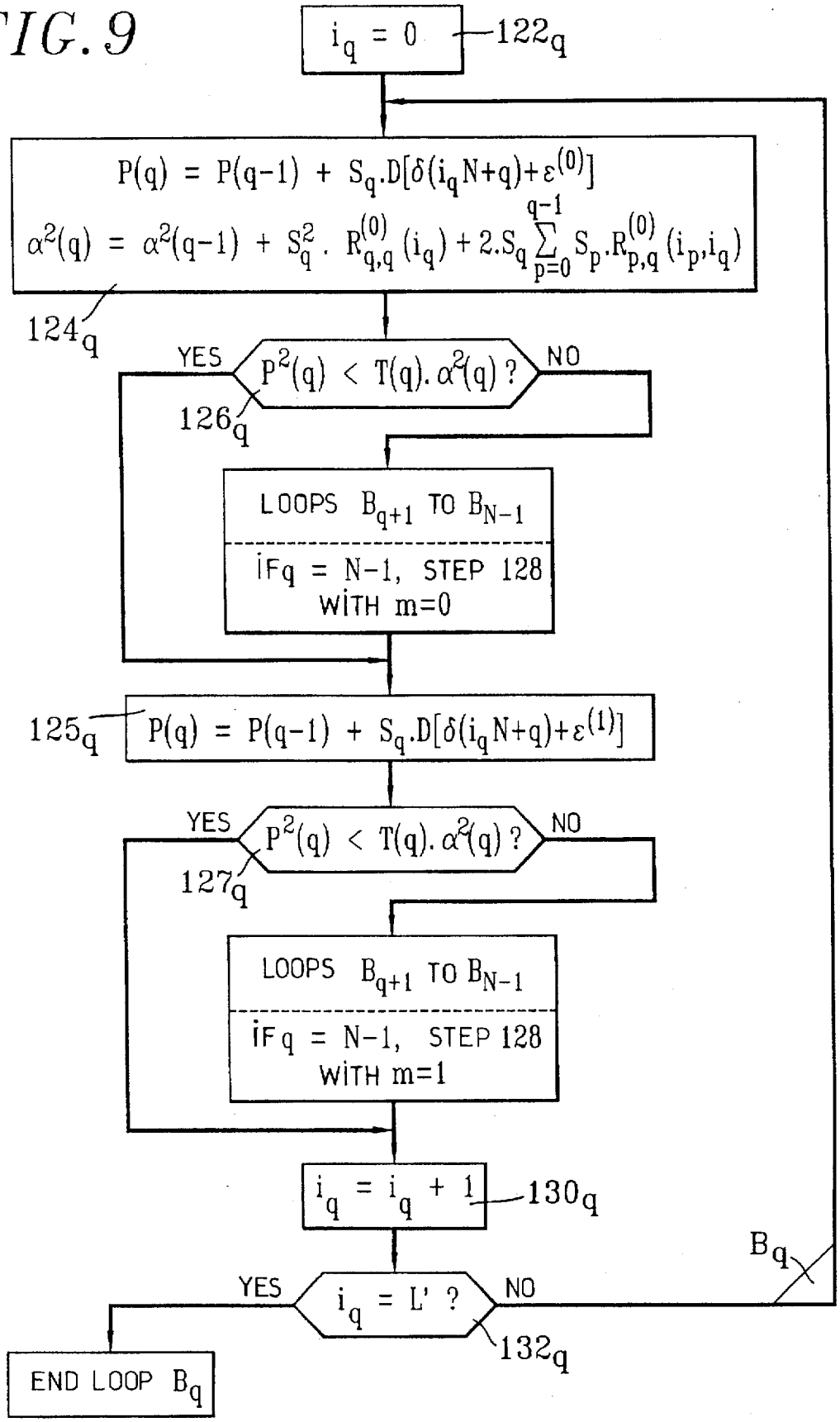
FIG. 9 is a flowchart illustrating a sub-optimal excitation search procedure in the second embodiment.

If, to simplify the account without affecting the generality, we consider the case (M=2, μ=1) in which only the components of the vectors $R_{p,p}^{(0)}$ and of the matrices $R_{p,q}^{(0)}$ are stored in memory, the search for the excitation can be performed in accordance with the flowchart of FIGS. 5A and 5B by modifying the loops $B_q(0 \leqq q < N)$ in the manner indicated in FIG. 9. In step $\mathbf{124}_q$, the terms P(q) and $\alpha^2(q)$ are calculated as in the case of FIGS. 5A and 5B in relation to the group m=0. If the test $\mathbf{126}_q$ shows that $P^2(q)/\alpha^2(q)$ is greater than threshold T(q), the lower loops are executed, commencing with $B_{q+1}$ or, if q=N−1, updating 128 is performed of the threshold and of the excitation parameters which furthermore comprise the index m then taken equal to 0. Next we go to step $\mathbf{125}_q$, which is executed directly if the test $\mathbf{126}_q$ shows that $P^2(q) < T(q) \cdot \alpha^2(q)$. In step $\mathbf{125}_q$ the term P(q) is calculated in relation to the group m=1. The corresponding term $\alpha^2(q)$ is not recalculated, given that, in the approximation employed, it is regarded as equal to the term $\alpha^{(2)}(q)$ calculated previously for m=0. The test $\mathbf{127}_q$ then consists in comparing $P^2(q)$ and $T(q) \cdot \alpha^2(q)$. If $P^2(q)/\alpha^2(q)$ is greater than the threshold T(q), the lower loops are executed, commencing with $B_{q+1}$ or, if q=N−1, updating 128 is performed of the threshold and of the excitation parameters, which comprise the index m then taken equal to 1. We next go to the incrementation $\mathbf{130}_q$ of the integer $i_q$ which is executed directly if the test $\mathbf{127}_q$ shows that $P^2(q) < T(q) \cdot \alpha^2(q)$.

EXAMPLE 1

In this first example implementing the first embodiment described above, use is made of 30 ms frames (i.e. Λ=240 samples at 8 kHz), subdivided into 5 ms sub-frames (L=40). The ACELP codebook comprises codes of N=4 pulses each having L'=11 possible positions given by relation (2) with δ=1 and ε=0. If a pulse occupies the last position, which is greater than or equal to L=40, its amplitude is zeroed by the decoder. An excitation code corresponds to a truncated code from the codebook (samples 0 to L−1=39 only), and may therefore contain 0, 1, 2, 3 or 4 pulses. The distribution of pulses in a sub-frame is presented in Table I. The allocation of the bit rate per frame is presented in Table II. 204 bits per frame correspond to a bit rate of 6.8 kbits/s.

TABLE I

| p | $S_p$ | $E_p = \{pos_{i,p}\}$ | | | | | | | | | | |
|---|---|---|---|---|---|---|---|---|---|---|---|---|
| 0 | +1 | 0 | 4 | 8 | 12 | 16 | 20 | 24 | 28 | 32 | 36 | (40) |
| 1 | −1 | 1 | 5 | 9 | 13 | 17 | 21 | 25 | 29 | 33 | 37 | (41) |
| 2 | +1 | 2 | 6 | 10 | 14 | 18 | 22 | 26 | 30 | 34 | 38 | (42) |
| 3 | ±1 | 3 | 7 | 11 | 15 | 19 | 23 | 27 | 31 | 35 | 39 | (43) |
| | i | 0 | 1 | 2 | 3 | 4 | 5 | 6 | 7 | 8 | 9 | 10 |

TABLE II

| Parameters | Sub-frames 1 and 4 | Sub-frames 2, 3, 5 and 6 | Total per frame |
|---|---|---|---|
| LPC | | | 30 |
| LTP delay (T) | 8 | 5 | 36 |
| Pulses | 14 + 1 | 14 + 1 | 90 |
| Sign of β | 1 | 1 | 6 |
| Gains G and β | 7 | 7 | 42 |
| Total | | | 204 |

In a known manner, the LPC coefficients are converted into the form of vectorially quantized line spectrum parameters (LSP). The LTP delays, which can take 256 integer or fractional values between 19⅓ and 143 are quantized over 8 bits. These 8 bits are transmitted in sub-frames 1 and 4 and, for the other sub-frames, a differential value is coded on 5 bits only. The codebook contains $K=(L')^N=14641$ code words. 14 bits are therefore necessary to code the positions, plus one bit giving the sign of pulse p=3.

In this Example 1, the implementation of the invention makes it possible to divide by 2.5 the size of the memory required by the coder to store the components of the covariance matrix, while still obtaining output signals identical to those which could be obtained with the earlier ACELP coder. The random access memory required to store the data and variables which is useful for the coder and the components of the covariance matrix is thus reduced from 2264+1936=4200 words of 16 bits to 2264+770=3034 words of 16 bits, thus allowing addressing on 12 bits which is compatible with current static RAM memories and digital signal processors (DSP).

EXAMPLE 2

In this second example implementing the first embodiment described above, use is made of the 30 ms frames (Λ=240) subdivided into 6 ms sub-frames (L=48). The ACELP codebook comprises codes of N=3 pulses each having L'=16 possible positions given by relation (2) with δ=1 and ε=0. Since δL'N=L, the code words are not truncated to obtain the excitation which always contains N=3 pulses.

The LPC and LTP parameters are determined in a manner similar to Example 1. The codebook contains $K=(L')^N=4096$ code words. 12 bits are therefore required to code the positions. The bit rate is then 158 bits per frame, i.e. 5.3 kbits/s.

In this Example 2, the implementation of the invention makes it possible to divide by 2.8 the memory required by the coder to store the components of the covariance matrix, while still obtaining identical output signals (a saving of 1488 words of 16 bits allowing addressing on 12 bits in the random access memory).

EXAMPLE 3

In this third example implementing the second embodiment with the sub-optimal search procedure (μ=1), use is made of the 30 ms frames ($\Lambda$=240) subdivided into 7.5 ms sub-frames (L=60). The ACELP codebook is cons-tructed from M=2 groups of N=4 sets of positions with cardinal L'=8. The positions are given by relations ($2_m$) with $\delta$=2, $\epsilon^{(0)}$=0 and $\epsilon^{(1)}$=1. The code words of the codebook have a length $\delta$L'N=64 greater than the length L of a sub-frame. They must therefore be truncated (samples 0 to L−1=59 only) to obtain an excitation containing 2, 3 or 4 pulses. The distribution of the pulses in a sub-frame is presented in Table III for the group m=0 and in Table IV for the group m=1.

TABLE III

| p | $S_p$ | $E_p^{(0)}=(pos_{i,p}^{(0)})$ | | | | | | | |
|---|---|---|---|---|---|---|---|---|---|
| 0 | ±1 | 0 | 8 | 16 | 24 | 32 | 40 | 48 | 56 |
| 1 | ±1 | 2 | 10 | 18 | 26 | 34 | 42 | 50 | 58 |
| 2 | ±1 | 4 | 12 | 20 | 28 | 36 | 44 | 52 | (60) |
| 3 | ±1 | 6 | 14 | 22 | 30 | 38 | 46 | 54 | (62) |
| | i | 0 | 1 | 2 | 3 | 4 | 5 | 6 | 7 |

TABLE IV

| p | $S_p$ | $E_p^{(1)}=\{pos_{i,p}^{(1)}\}$ | | | | | | | |
|---|---|---|---|---|---|---|---|---|---|
| 0 | ±1 | 1 | 9 | 17 | 25 | 33 | 41 | 49 | 57 |
| 1 | ±1 | 3 | 11 | 19 | 27 | 35 | 43 | 51 | 59 |
| 2 | ±1 | 5 | 13 | 21 | 29 | 37 | 45 | 53 | (61) |
| 3 | ±1 | 7 | 15 | 23 | 31 | 39 | 47 | 55 | (63) |
| | i | 0 | 1 | 2 | 3 | 4 | 5 | 6 | 7 |

The codebook contains $K=M\cdot(L')^N=8192$ code words. 13 bits are therefore required to code the positions, plus 4 bits giving the signs of the pulses. With the synthesis parameters being coded as in the case of Examples 1 and 2, the coder produces 153 bits per frame, this representing a bit rate of 5.1 kbits/s.

In this example, the implementation of the invention makes it possible to divide by 9.8 the size of the memory required by the coder to store the components of the cova-riance matrix, the reduction in random access memory required being 3680 words of 16 bits (416 useful compo-nents of the matrix U instead of $(\delta L'N)^2=4096$). The second embodiment of the invention, applied without the sub-optimal procedure, would necessitate storing 832 compo-nents of the matrix U.

I claim:

1. In a code-excited linear prediction (CELP) speech coding method, comprising the steps of: digitizing a speech signal as successive frames of L samples; adaptively deter-mining synthesis parameters defining synthesis filters, and excitation parameters including, for each frame, pulse posi-tions in an excitation code of L samples belonging to a predetermined algebraic codebook and an associated exci-tation gain; and transmitting quantization values represen-tative of the determined parameters, wherein the algebraic codebook is defined on the basis of at least one group of N sets of possible pulse positions in codes of at least L samples, a code from the codebook being represented by N pulse positions belonging respectively to the N sets of positions of a group, wherein determining the excitation parameters relating to a frame includes selecting a code from the codebook which maximizes a quantity $P_k^2/\alpha_k^2$, in which $P_k=D\cdot c_k^T$ denotes the scalar product of a code $c_k$ from the codebook and a target vector D depending on the speech signal of the frame and on the synthesis parameters, and $\alpha_k^2$ denotes the energy in the frame of the code $c_k$ filtered by a compound filter made up of the synthesis filters and a perceptual weighting filter, calculating the energies $\alpha_k^2$ including calculating and storing in a memory components of a covariance matrix $U=H^T\cdot H$, where H denotes a lower triangular Toeplitz matrix with L rows and L columns, formed from the impulse response h(0), h(1), . . . , h(L−1) of said compound filter;

the improvement comprising, for at least one group of N sets, storing in the memory only those components of the covariance matrix which are of the form:

$$U(pos_{i,p},pos_{i,p})=\sum_{n=pos_{i,p}}^{L-1}[h(n-pos_{i,p})]^2$$

with $0\leqq p<N$ and those which are of the form:

$$U(pos_{i,p},pos_{j,q})=\sum_{n=\max(pos_{i,p},pos_{j,q})}^{L-1}h(n-pos_{i,p})h(n-pos_{j,q})$$

with $0\leqq p<q<N$, $pos_{i,p}$ and $pos_{j,q}$ respectively denoting the positions of order i and j in the sets of said group containing possible positions for the pulses p and q of the codes from the codebook.

2. The improvement of claim 1, wherein, for a group of N sets, said memory-stored components of the covariance matrix are structured in the form of N correlation vectors and N(N−1)/2 correlation matrices, each correlation vector $R_{p,p}$ being associated with a pulse number p in the codes from the codebook ($0\leqq p<N$) and being of dimension $L_p'$ equal to the cardinal of the set from said group which contains possible positions for the pulse p, with components i ($0\leqq i<L_p'$) of the form $R_{p,p}(i)=U(pos_{i,p},pos_{i,p})$, and each correlation matrix $R_{p,q}$ being associated with two different pulse numbers p,q in the codes from the codebook ($0\leqq p<q<N$) and having $L_p'$ rows and $L_q'$ columns with components of the form $R_{p,q}(i,j)=U(pos_{i,p},pos_{j,q})$ in row i and in column j ($0\leqq i<L_p'$ and $0\leqq j<L_q'$).

3. The improvement of claim 2, wherein the sets of said group which contain possible positions for a pulse of the codes from the codebook all have the same cardinal L', the position of order i in the set of the possible positions for the pulse p ($0\leqq i<L'$, $0\leqq p<N$) being given by:

$$pos_{i,p}=\delta\cdot(iN+p)+\epsilon,$$

$\delta$ and $\epsilon$ being two integers such that $\delta>0$ and $\epsilon\geqq 0$.

4. The improvement of claim 3, wherein the calculation of the N correlation vectors relating to a group comprises an initialization of an integer variable k and of an accumulation variable cor, and a loop indexed by an integer i decreasing from L'−1 to 0, the iteration i in said loop comprising the successive calculations of the components $R_{p,p}(i)$ of said vectors for p decreasing from N−1 to 0, a component $R_{p,p}(i)$ being taken equal to the accumulation variable cor after $\delta$ incrementations of the integer variable k and $\delta$ correspond-ing additions of the terms $h(k)\cdot h(k)$ to the accumulation variable cor.

5. The improvement of claim 3, wherein the calculation of the N(N−1)/2 correlation matrices relating to a group comprises, for every integer t in the interval [1,N−1] and every integer d' in the interval [0,L'−1], an initialization of an integer variable k and of an accumulation variable cor, and a loop indexed by an integer i decreasing from L'−1−d' to 0, the iteration i in said loop comprising the successive calculations of the components $R_{p,p+t}(i,i+d')$ of said matrices for p decreasing from N−1−t to 0 and then, if i>0, the successive calculations of the components $R_{q,q+N-t}(i+d',i-1)$ of said matrices for q decreasing from t−1 to 0, a component $R_{p,p+t}(i,i+d')$ or $R_{q,q+N-t}(i+d',i-1)$ being taken equal to the accumulation variable cor after δ incrementations of the integer variable k and δ corresponding additions of the terms h(k)·h(k+d) to the accumulation variable cor, with d=δ·(t+d'N).

6. The improvement of claim 2, wherein the algebraic codebook is defined on the basis of M groups of N sets of L' possible positions for a pulse of a code from the codebook, with M>1, the position of order i in the set of the group m containing the possible positions for the pulse p (0≦i<L', 0≦m<M, 0≦p<N) being given by:

$$pos_{i,p}^{(m)}=\delta\cdot(iN+p)+\epsilon^{(m)}$$

δ, $\epsilon^{(0)}, \ldots, \epsilon^{(M-1)}$ being integers such that $0\leqq\epsilon^{(0)}<\ldots<\epsilon^{(M-1)}<\delta$.

7. The improvement of claim 6, wherein the correlation vectors and the correlation matrices are stored in memory only for μ of the groups, μ being an integer such that 1≦μ<M.

8. The improvement of claim 7, wherein the calculation of the N correlation vectors relating to a group comprises an initialization of an integer variable k and of an accumulation variable cor, and a loop indexed by an integer i decreasing from L'−1 to 0, the iteration i in said loop comprising the successive calculations of the components $R_{p,p}(i)$ of said vectors for p decreasing from N−1 to 0, a component $R_{p,p}(i)$ being taken equal to the accumulation variable cor after δ incrementations of the integer variable k and δ corresponding additions of the terms h(k)·h(k) to the accumulation variable cor.

9. The improvement of claim 7, wherein the calculation of the N(N−1)/2 correlation matrices relating to a group comprises, for every integer t in the interval [1, N−1] and every integer d' in the interval [0, L'−1], an initialization of an integer variable k and of an accumulation variable cor, and a loop indexed by an integer i decreasing from L'−1−d' to 0, the iteration i in said loop comprising the successive calculations of the components $R_{p,p+t}(i,i+d')$ of said matrices for p decreasing from N−1−t to 0 and then, if i>0, the successive calculations of the components $R_{q,q+N-t}(i+d',i-1)$ of said matrices for q decreasing from t−1 to 0, a component $R_{p,p+t}(i,i+d')$ or $R_{q,q+N-t}(i+d',i-1)$ being taken equal to the accumulation variable cor after δ incrementations of the integer variable k and δ corresponding additions of the terms h(k)·h(k+d) to the accumulation variable cor, with d=δ·(t+d'N).

10. The method for code excited linear prediction (CELP) speech coding according to claim 9, wherein the N correlation vectors are calculated for at least two groups in said loop indexed by i.

11. The improvement of claim 6, wherein the calculation of the N correlation vectors relating to a group comprises an initialization of an integer variable k and of an accumulation variable cor, and a loop indexed by an integer i decreasing from L'−1 to 0, the iteration i in said loop comprising the successive calculations of the components $R_{p,p}(i)$ of said vectors for p decreasing from N−1 to 0, a component $R_{p,p}(i)$ being taken equal to the accumulation variable cor after δ incrementations of the integer variable k and δ corresponding additions of the terms h(k)·h(k) to the accumulation variable cor.

12. The improvement of claim 6, wherein the calculation of the N(N−1)/2 correlation matrices relating to a group comprises, for every integer t in the interval [1, N−1] and every integer d' in the interval [0,L'−1], initialization of an integer variable k and of an accumulation variable cor, and a loop indexed by an integer i decreasing from L'−1−d' to 0, the iteration i in said loop comprising the successive calculations of the components $R_{p,p+t}(i,i+d')$ of said matrices for p decreasing from N−1−t to 0 and then, if i>0, the successive calculations of the components $R_{q,q+N-t}(i+d',i-1)$ of said matrices for q decreasing from t−1 to 0, a component $R_{p,p+t}(i,i+d')$ or $R_{q,q+N-t}(i+d',i-1)$ being taken equal to the accumulation variable cor after δ incrementations of the integer variable k and δ corresponding additions of the terms h(k)·h(k+d) to the accumulation variable cor, with d=δ·(t+d'N).

13. The method for code excited linear prediction (CELP) speech coding according to claim 12, wherein the N(N−1)/2 correlation matrices are calculated for at least two groups in said loops indexed by i.

* * * * *